US006100674A

United States Patent [19]

Dohnal et al.

[11] Patent Number: 6,100,674

[45] Date of Patent: Aug. 8, 2000

[54] METHOD OF MONITORING A TAP CHANGER

[75] Inventors: Dieter Dohnal, Lappersdorf; Christian Heudecker, Zeitlarn; Karsten Viereck, Diesenbach, all of Germany

[73] Assignee: Maschinenfabrik Reinhausen GmbH, Regensburg, Germany

[21] Appl. No.: 09/174,566

[22] Filed: Oct. 16, 1998

[30] Foreign Application Priority Data

Oct. 22, 1997 [DE] Germany ..... 197 46 574

[51] Int. Cl.[7] ..... G05F 4/147

[52] U.S. Cl. ..... 323/256; 347/528.33

[58] Field of Search ..... 323/255, 256; 347/528.33, 528.32

[56] References Cited

U.S. PATENT DOCUMENTS 5,550,459 8/1996 Laplace ..... 323/255

FOREIGN PATENT DOCUMENTS 246 409 6/1987 Germany .
42 14 431 11/1993 Germany .
2 559 138 12/1996 Japan .

OTHER PUBLICATIONS

"Dissertation—Einsatz von Sensoren in Transformatoren" Karsten Viereck, Technische Universitat Dresden,Fakultat Elektrotechnik Nov. 12, 1992, pp. 1–92.

*Primary Examiner*—Shawn Riley
*Attorney, Agent, or Firm*—Herbert Dubno

[57] ABSTRACT

A method of monitoring a tap changer in which measured values representing the status of the tap change operation are associated with positions of the tap changer and the position range or time range for the tap change is subdivided into partial intervals for which characteristic values of the measurement are calculated by a calculating rule, e.g. averaging. These characteristic values are compared with stored parameter data and operation categories are established which are then used exclusively for the further information processing.

8 Claims, 4 Drawing Sheets

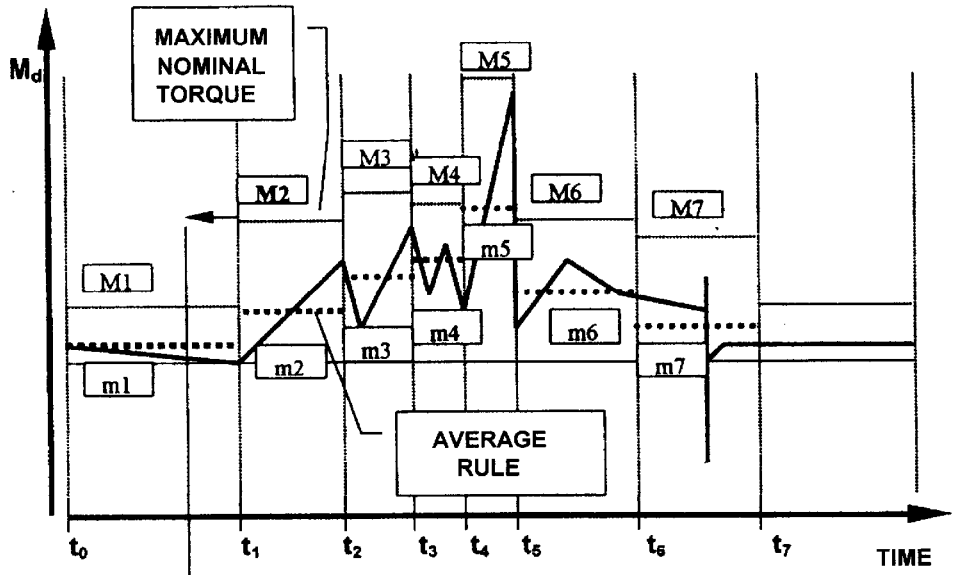

| TIME | NORMAL TORQUE | FUNCTION SEQUENCE | AVERAGE VALUE |
|---|---|---|---|
| $t_0 - t_1$ | M1 | GENEVA ROLLER ENGAGES | m1 |
| $t_1 - t_2$ | M2 | FINE SELECTOR TURNOFF | m2 |
| $t_2 - t_3$ | M3 | PRESELECTOR TURNOFF | m3 |
| $t_3 - t_4$ | M4 | FINE SELECTOR AND PRESELECTOR SWITCHOVER | m4 |
| $t_4 - t_5$ | M5 | PRESELECTOR TURN-ON | m5 |
| $t_5 - t_6$ | M6 | FINE SELECTOR TURN-ON & GENEVA ROLLER DISENGAGES | m6 |
| $t_6 - t_7$ | M7 | LOAD SWITCH JUMP | m7 |

| OVERSTEPPING OR UNDER-STEPPING OF NORMAL TORQUE | CATEGORY | SIGNAL |
|---|---|---|
| >100% | 0DH | SHUT DOWN |
| 90% | 0CH | |
| 80% | 0BH | |
| 70% | 0AH | MAINTENANCE |
| 60% | 09H | REQUIRED |
| 50% | 08H | |
| 40% | 07H | |
| 30% | 06H | |
| 20% | 05H | |
| 10% | 04H | $M_d$ |
| 0 | 03H | IN ORDER |
| -10% | 02H | |
| -20% | 01H | |
| < -30% | 00H | |

FIG. 3

METHOD OF MONITORING A TAP CHANGER

FIELD OF THE INVENTION

Our present invention relates to a method of monitoring a tap changer and, more particularly, to a method of monitoring the function of a tap changer wherein measured values are detected and classified as a way of determining whether the tap changer should be shut down, subjected to maintenance, or the like.

BACKGROUND OF THE INVENTION

Japanese patent publication Hei-2-213105 describes a process for monitoring a tap changer whereby different measured values, like pressure, the load on the actuating elements, the current, or impurities in the oil, are detected. The present state of the tap changer is described in terms of these measurements to provide an indication of the actual status of the tap changer, these measured values are stored and the measured values are compared with previously stored, apparatus-specific setpoint values and the comparison used, for example, to shut down the tap changer in the case of an emergency situation or the like. If there are deviations as a result of this comparison, signals are generated which can provide warnings for the automatic shutdown of the tap changer.

German patent document DE 42 14 431 C2 describes a process in which the position of the tap changer is determined and this system can use a position changer which signals the instantaneous position of the drive shaft of a motor drive connected with the tap changer. The output from this generator can be converted into a binary value representing the position of the motor shaft and hardware decoding or a microprocessor controller can be provided to process the binary values which result. In this case the microprocessor controller monitors the position signaled by the position generator of the drive shaft and hence the movement thereof.

Published Japanese application Sho-60-176213 describes a system in which the torque on the drive shaft which is produced by the motor drive and with which the tap changer operates is detected for each actuation of the tap changer, the curve of the torque with time is compared with a setpoint torque curve which may be typical specifically to the tap changer and the result of this comparison is used, if necessary, to shut down the system should need arise. A similar process has also been described in East German patent document 246 409 in which the curve of the torque as a function of time is measured during a tap change operation and the result is compared with a torque curve typical of the tap changer.

As a rule, measured values which are to be compared later with setpoint values are stored as ASCII data. It is possible to effect a data compression to minimize the steps required in the storage medium for storage of the data. The measured values are customarily a succession of absolute values at certain points in time which are applied to the storage medium. The significance of the values depend upon the particular input channels on which the data arrive.

The publication "Hydro TEC HT2000" of Deltatronic Instruments GmbH, of Austria, relates to a process where the information is processed as ASCII data in storage in the following manner, given for a storage space corresponding to 30 bytes.

Starting time with the measured value will be 11:49:11 28
Close of the measurement 12:59:11 17 (17 is the new value for the subsequent measurement.)

| Address | 00 | 01 | 02 | 03 | 04 | 05 | 06 | 07 | 08 | 09 | 0A | 0B | 0C | 0D | 0E | 0F |
|---|---|---|---|---|---|---|---|---|---|---|---|---|---|---|---|---|
| Value | FF | 31 | 31 | 3A | 34 | 39 | 3A | 31 | 31 | 20 | 20 | 20 | 32 | 38 | 0D | 0A |
| Address | 20 | 21 | 22 | 23 | 24 | 25 | 26 | 27 | 28 | 29 | 2A | 2B | 2C | 2D | 2E | 2F |
| Value | 31 | 32 | 3A | 35 | 39 | 3A | 31 | 31 | 20 | 20 | 20 | 31 | 37 | 0D | 0A | FF |

A further variant for the storage of measured data is known from the Viereck dissertation: Use of Sensors in Transformers, TU Dresden, Germany 1992. In a fixed time period, which is subdivided into defined time intervals, with a constant analog value, can be broken down in the time intervals into hexidecimal values so that only two addresses of the storage medium need indicate variable time periods.

Example

| Address | 01 | 02 | 03 | 04 | 05 | 06 | 07 | 08 |
|---|---|---|---|---|---|---|---|---|
| Value | FF | FF | 0E | 1C | 06 | 11 | FF | FF |

In this case, the storage medium contains under the addresses 03H and 04H the information which has been measured for 14 intervals (0E H), namely, the value 28 (1C H).

If the starting time of the measurement processes is known in the processor-controller and each measurement interval is a constant period, say five minutes, the measurement remains a constant extending over relatively long time spans.

Both of these processes are associated with a number of drawbacks. If, for example, a data compression is carried out using conventional data processing techniques, the values below one another are no longer comparable directly without decompression.

The stored data, in addition, contain only an indication of their absolute value and can only be correlated with measured values of other measurement sequences in terms of such absolute values.

Furthermore, for an indication of the exceeding of limiting values by specific measured data requires an individual definition of the limiting value. For example, in the case of tap selectors in which the torque is an indicator of the state and is evaluated, limiting values should be provided as a function of nominal values to generate signals representing the overstepping. For example, it can be established that a 300% excess above the nominal torque should shut down the drive instantaneously. The measured torque exceeding 150% of nominal torque can generate a signal "no longer permissible", for example, which will not shut down the tap changer immediately but will be generated by the monitoring system to signal that maintenance is required. In either case, the limiting value is the nominal value of the torque which can represent 100% of the torque actually required. This value must be supplied and usually will differ from tap changer to tap changer. The absolute value of the measurement is therefore meaningless. Finally it is a drawback in these earlier systems that they require large capacity memories to store and evaluate the respective measured values.

OBJECTS OF THE INVENTION

It is the principal object of the present invention to provide a monitoring process for tap changers which simplifies the data processing, enables data compaction and minimizes the memory requirements but will nevertheless facilitate storage and comparison of values and render the outputs more meaningful than earlier systems.

It is another object of the invention to provide a monitoring system which does not require the establishment of precise limiting values for each kind of tap changer and thus which will allow the monitoring system to be practically universally applicable to tap changers of different kinds.

Still another object of the invention is to provide a method of monitoring a tap changer which avoids drawbacks of earlier systems for this purpose.

SUMMARY OF THE INVENTION

These objects and others which will become apparent hereinafter are attained, in accordance with the invention in a method of monitoring operation of a tap changer for a power transformer which comprises the steps of:

(a) obtaining measured values at short intervals from one another representing actual conditions of a tap changer during a tap changing operation;

(b) detecting positions of the tap changer during the tap changing operation and associating respective ones of the measured values with respective ones of the detected positions;

(c) subdividing a range of detected positions or a corresponding time range ($t_0$–$t_7$) into a succession of partial ranges ($t_0$–$t_1$, $t_1$–$t_2$, . . . , $t_6$–$t_7$) in accordance with a subdivision function during the tap changing operation;

(d) within each of the partial ranges ($t_0$–$t_1$, $t_1$–$t_2$, . . . , $t_6$–$t_7$), determining a characteristic value (m1–m7) of the measured value based upon a predetermined set of calculation rules;

(e) comparing the characteristic values (m1–m7) with parameter data stored in nonvolatile memory and classifying the characteristic values in selected classification categories (00H–0H) based upon the classification; and (f) further processing only these classification categories and generating respective category dependent signals therewith.

According to a feature of the invention, after association of the respective measured values with the position, processing is effective in which each measured value is compared with the maximum permissible limiting value (M1–M7) which is also stored in nonvolatile memory and forms part of the parameter data and, upon exceeding this limiting value, an emergency signal is immediately generated.

The stored parameter data can correspond to deviation (−30% to +100%) of the nominal value and corresponding classification categories (0H–0D) can be associated with these parameter data.

Before commencement of the monitoring of the function of the tap changer, a zero measurement can be effected at the tap changer prepared for initiation of operation and corresponding to which the nominal value (0) of the measured value is determined as the starting point for the parameter data.

According to still another feature of the invention the torque at the drive shaft between the motor drive and the tap changer can serve as the measured value. The predetermined set of calculating rules can be arithmetic averaging.

With the process of the invention there is a compaction of the measured and comparison values which enter into the monitoring operation. The first "compaction" is the association of the respective measured value with the position of the tap changer, i.e. the actual setting of the tap changer during the tap changing operation. The position can be detected directly, e.g. via a resolver, or indirectly via a time measurement. A second "compaction" is effected in that the total position range through which the tap changer runs in a complete tap change under load, is subdivided into individual position ranges and for each of these position ranges, a single characteristic value of the measurement is determined by predetermined calculation rules. A third compaction can result from the comparison of the characteristic values with predetermined stored parameter data and are classified so that only the classified data need be stored or need serve as the basis for outputting corresponding signals and warnings.

The result with the process of the invention is thus encrypted data which itself has no directly ascertainable relationship to the underlying measured values.

The important advantage of the invention is that this process can establish apparatus-specific limiting values based upon percentages of the nominal value and whose absolute levels can be stored. The parametric data can represent relative values which relate to the nominal values.

In summary, the process of the invention is characterized by the fact that it enables a classification of the data within a time or position range by calculating characteristic values of measured values and comparing them with parameter data for these characteristic values representing the time for position range. Not only are these categories or characteristic values stored but characteristic values of the individual segments of the process can be described by the parameter data. The intrinsic measurement data of the output data has a cryptic character.

The process does not require determination of specific thresholds but rather can rely on inputting of the nominal value, i.e. the 100% value and thereby can permit a direct comparison of the data from any specific apparatus. The system is fully reproducible, assuming that the parameter and classification data and steps are available.

BRIEF DESCRIPTION OF THE DRAWING

The above and other objects, features, and advantages will become more readily apparent from the following description, reference being made to the accompanying drawing in which:

FIG. 3 is a diagram illustrating how the information is processed; and

SPECIFIC DESCRIPTION

Figure 4:
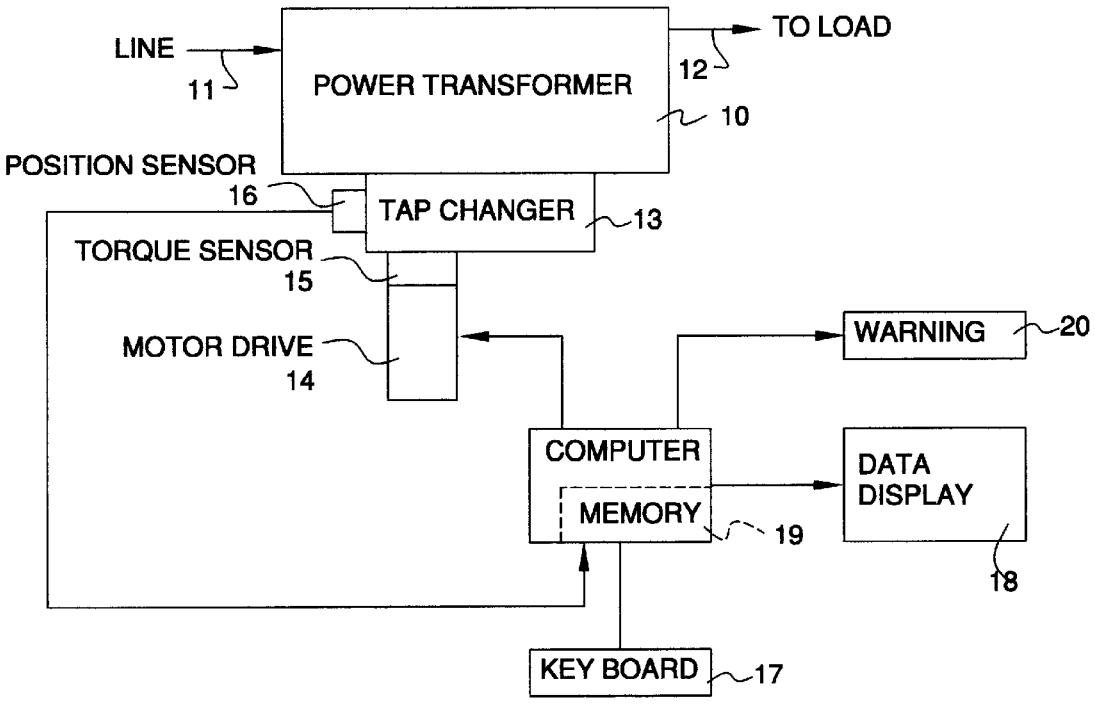
FIG. 4 is a block diagram of an apparatus for utilizing the monitoring method of FIG. 1.

In FIG. 4, we have shown a power transformer 10 connected between a power distribution line 11 and a load 12 and provided with a tap changer 13 which may be of the type described in the commonly-assigned copending application Ser. No. 09/165,494 filed Oct. 2, 1998 (Attorney's docket number 20864). That tap changer has a motor drive, analogous to the motor drive 14 of FIG. 4 which, in turn, drives a shaft connected to a single geneva mechanism which is coupled to additional shafts operating the tap selector switches for the several phases, the breaker contacts and the vacuum-switching cell actuators, as well as a coarse selection contact or reversing contact arrangement.

That tap changer can utilize impedances connected between respective movable tap selection contacts and the load, the vacuum-switching cell being connected across the opposite ends of those impedances which are tied by the breaker contacts to the load. In operation, the sequencing of the various movable contacts allows shifting of the tap changer contacts from one stationary tap to another stationary tap by rotation of the shafts and, of course, by an electric motor driving the input shaft to the tap changer. The operation of such a tap changer is fully described in that copending application which is incorporated herein by reference. Other tap changers with electric motor drives can, of course, also be used and, in accordance with the principles of the present invention, a detector 15 can be connected to the shaft between the motor drive 14 and the tap changer 13 and can provide an input to the computer which effects the monitoring of the tap changing operation. A position sensor 16 generates a position signal for the computer representing the instantaneous position in a tap-changing operation and the computer can be programmed via a keyboard 17 with the aid of a data table 18. The memory of the computer has been represented at 19 and a warning can be outputted at 20 to alert the operator to the need for maintenance. A shutdown signal can be generated at 21 as will be described in greater detail hereinafter.

Figure 1:
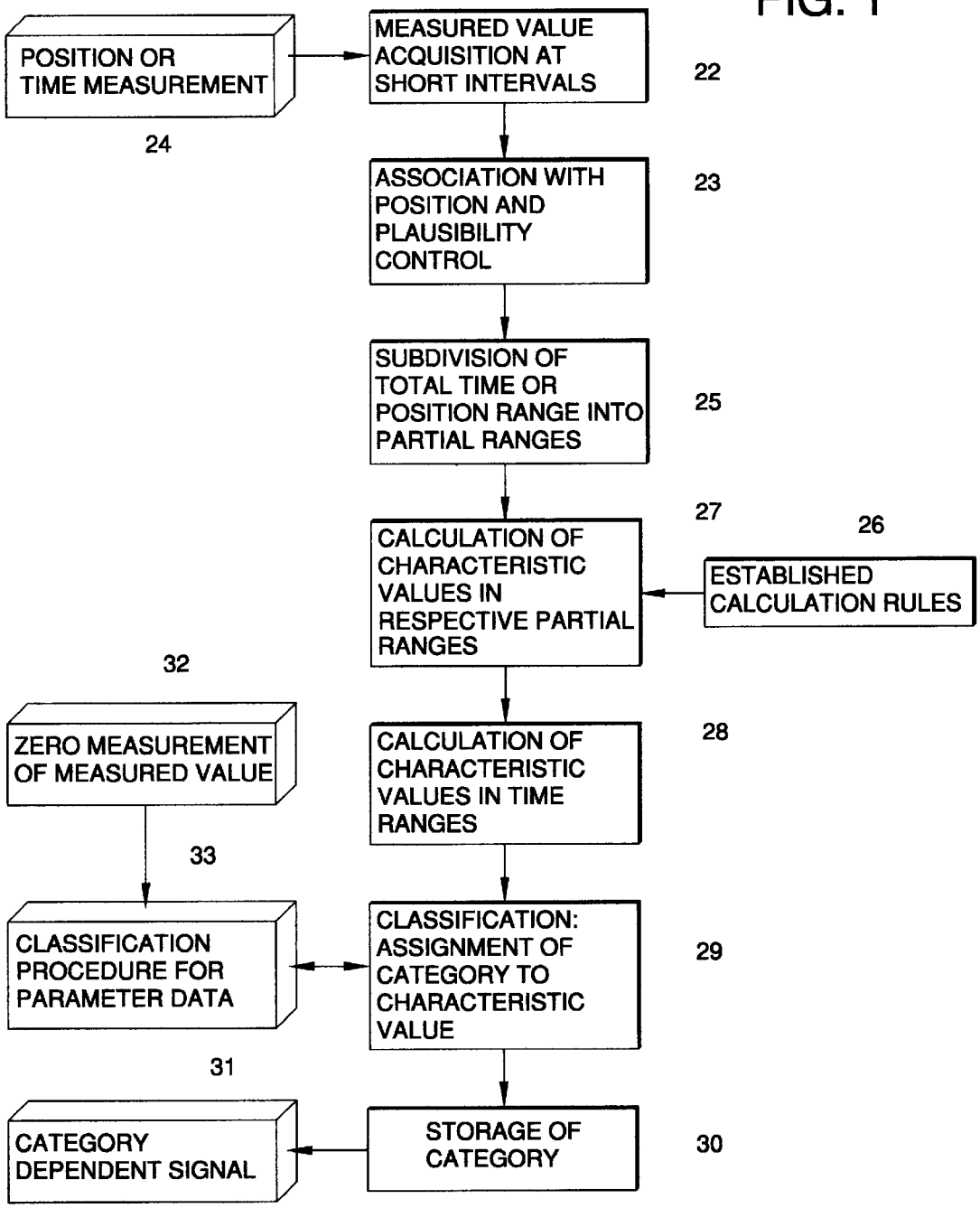
FIG. 1 is an information flow diagram illustrating the method of the invention.

As seen in FIG. 1, the initial step in the monitoring of a tap changer is to acquire typical measured values at short intervals and to register those measured values. As an example, the instantaneous torque can be acquired by the torque sensor 15 from the drive shaft of the motor drive actuating the tap changer. The invention is not, however, limited to measured values in terms of torque. Other inputs can include current and voltage applied to the motor drive, from which the effected power can be calculated, or other measurable parameters signaling the status of the tap changer at any particular point in time. The acquisition of the measured values has been represented at 22 in FIG. 1.

The measured value is then associated with the actual position of the tap changer during the tap change operation at 23, the position or time measurement being represented at 24 and being effected, for example, by the position sensor 16.

The detection of the instantaneous position can be effected directly, e.g. by a resolver connected to a shaft of the tap changer or indirectly by a time measurement, commencing from the moment that the motor drive is actuated and hence from the instant at which the tap change operation has been commenced. The total position or total tap changing time range for each complete tap change is subdivided into partial ranges typical of the tap change pattern.

In FIG. 3, for example, the torque has been plotted along the ordinate at $M_d$ against time along the abscissa, commencing with the initiation of the tap change operation at $t_0$. Here the interval $t_0$–$t_7$ has been subdivided into a plurality of typical time intervals $t_0$–$t_1$, $t_1$–$t_2$, $t_2$–$t_3$, $t_3$–$t_4$, $t_4$–$t_5$, $t_5$–$t_6$ and $t_6$–$t_7$. These intervals correspond, as is also clear from FIG. 3, respectively to the geneva roller engagement in a slot of the geneva wheel, switching of a fine selector movable contact from its stationary contact, switching of a preselector contact from its stationary contact, fine selector and preselector switchover, preselector movable contact making via selector movable contact making and geneva roller passing out of its slot, and load switching jump, respectively, corresponding to mean values $M_1$–$M_7$ of the torques. The nominal torques for each of these stages has been represented at FIG. 3 at $M_1$–$M_7$.

In FIG. 1 that subdivision of the position range or the time range into partial ranges is represented at 25.

Based upon a predetermined set of calculation rules 26 which can be inputted into the computer by keyboard programming utilizing the data display, there is within each of the partial ranges a determination at 27 of a characteristic torque value, namely, the average, or arithmetic mean from these values, characteristic values in terms of time may be generated at 28, whereupon the characteristic values are compared with previously stored parameter data to classify the characteristic values in selected classification categories at 29. These classification categories can be stored at 30 and the signals which are generated at 31 are exclusively dependent upon the respective category. The zero setting of the measured values is provided at 32 and the processing of the parameter data is represented at 33 in FIG. 1. The parameter data which is used for the classification step is stored nonvolatily in memory 19. The parameter data can include specific measured values, e.g. specific torque values, associated with respective classification categories. It has been found to be especially advantageous when these measured values are provided as percentage deviations from corresponding nominal values, i.e. from the nominal torque as has been represented in the lower table in FIG. 3. For this purpose it has been proved to be advantageous to carry out a zero setting of the corresponding measured value at which the nominal value will be determined and stored to serve as a basis for the classification step of the parameter data.

It is also possible, as has been indicated earlier, that these nominal values of the measured parameter, here the nominal torque, can differ within wide ranges depending upon the type of construction of the tap changer, i.e. are type and model specific. Via the described zero measurement, in spite of the different starting positions for a measured value, the percentage deviations in the parameter data can be directly associated with the respective category.

As a consequence in the system of the invention, the parameter data stored in the nonvolatile memory can include a set of deviations of measured values in terms of percentages of a nominal value and respective ones of the classification categories assigned to the percentages. In that case, the zero measurement which is carried out prior to initiating the tap change operation establishes the nominal value for the measured value as a starting value for the parameter data.

Only the brief categories need be stored and ultimately used for monitoring the function, i.e. signalling shutdown, warnings for maintenance, or any other need for concern.

From the respective characteristic resulting from the described comparison of the characteristic value with the parameter data, any requisite signalling or information display can be provided and it is also apparent from FIG. 3 that different categories can indicate the same signal or status.

Figure 2:
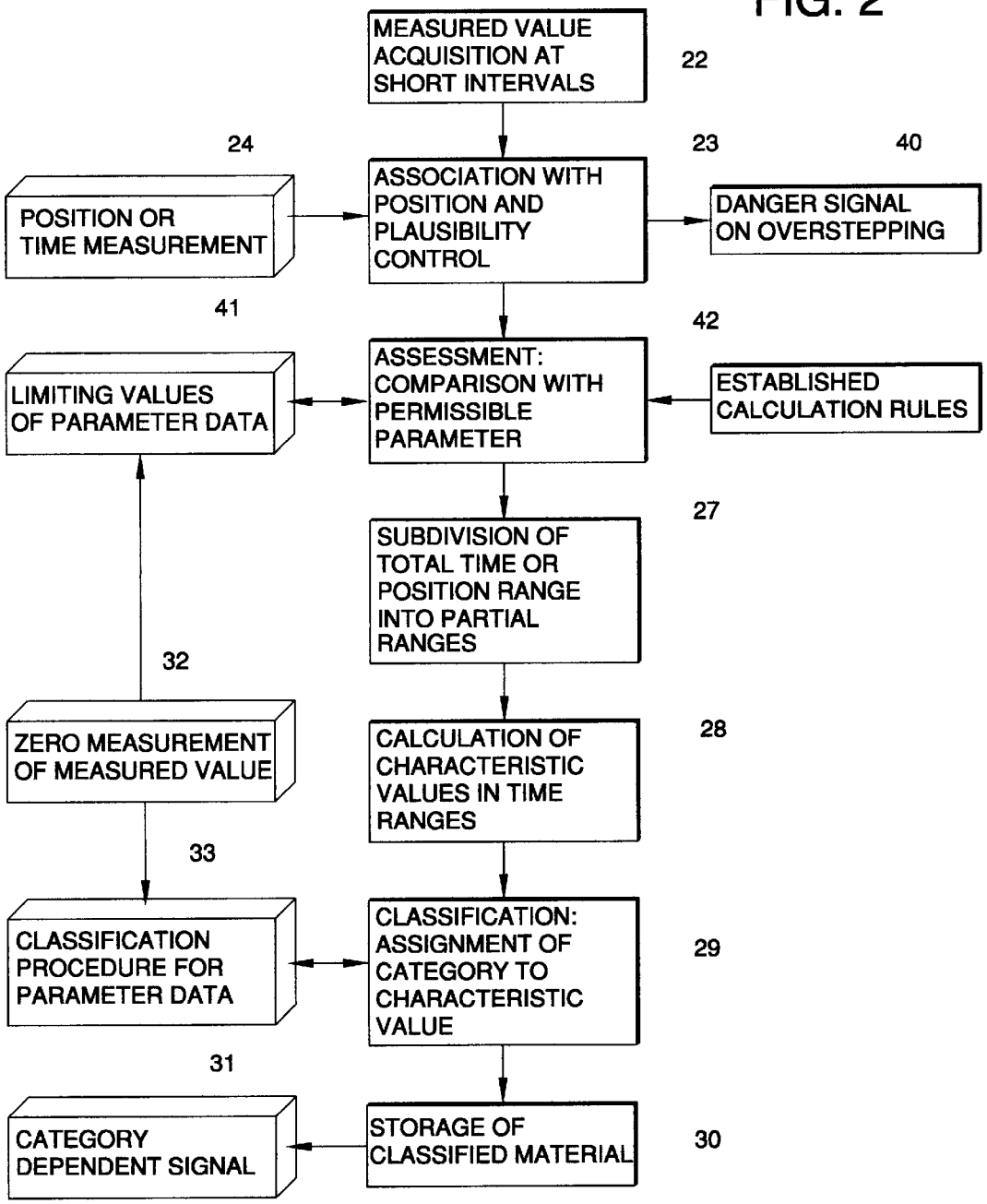
FIG. 2 is a diagram of that method with additional advantageous steps.

FIG. 2 shows a process which deviates from that displayed in FIG. 1 in minor respects. Here, after the described association of the measured value with the position at 23', a comparison can be effected between the position measurements and stored limiting values with the generation of an alert signal at 40 if the measured value should exceed such a limiting value.

With this system, therefore, there is a further comparison of the registered measured value with permissible parameters for the particular position and, upon overstepping of maximum permissible limits of the parameter data, warning signal 40 is immediately generated for shutdown of the motor drive.

The limiting value of the parameter data can be introduced at 41 and the comparison step with the parameter limits is represented at 42 in the information flow diagram of FIG. 2.

The method of FIG. 2 is otherwise similar to that of FIG. 1.

FIG. 3 shows graphically the torque $M_d$ as measured at the drive shaft of the motor drive as a function of time in driving a tap changer of the type shown in the aforedescribed copending application. The measured values are acquired at different points in time during the tap change operation and these points in time are associated in turn with the position of the tap changer during the operation as can be seen from the function sequence table. The maximum permissible nominal torques at the various positions have been represented at M1–M7 and the characteristic values in each partial range have been given as m1–m7 as averages or means.

The lower table of FIG. 3 shows one possible set of parameter data in which deviations from nominal are set out in percentage form with the associated categories and the signal or status associated with that category. The greatest deviation of course gives rise to a shutdown operation while others can indicate a maintenance requirement and still lower deviations can indicate that the tap changer is operating in order.

We claim:

1. A method of monitoring operation of a tap changer for a power transformer, comprising the steps of:

(a) obtaining measured values at short intervals from one another representing actual conditions of a tap changer during a tap changing operation;

(b) detecting positions of the tap changer during said tap changing operation and associating respective ones of said measured values with respective ones of the detected positions;

(c) subdividing a range of detected positions or a corresponding time range ($t_0$–$t_7$) into a succession of partial ranges ($t_0$–$t_1$, $t_{1-t2}$, . . . , $t_6$–$t_7$) in accordance with a subdivision function during said tap changing operation;

(d) within each of said partial ranges ($t_0$–$t_1$, $t_1$–$t_2$, . . . , $t_6$–$t_7$), determining a characteristic value (m1–m7) of the measured value based upon a predetermined set of calculation rules;

(e) comparing the characteristic values (m1–m7) with parameter data stored in nonvolatile memory and classifying the characteristic values in selected classification categories (00H–0DH) based upon the classification; and (f) further processing only these classification categories and generating respective category dependent signals therewith.

2. The method defined in claim 1, further comprising the step, subsequent to the association of respective ones of said measured values with said respective ones of said detected positions, of carrying out an assessment in which the respective measured value is compared with maximum permissible limiting values stored in said nonvolatile memory, and issuing an alert signal immediately upon the respective measured value overstepping a respective maximum permissible limiting value.

3. The method defined in claim 2 wherein the parameter data stored in said nonvolatile memory includes a set of deviations of measured values in terms of percentages of a nominal value and respective one of said classification categories assigned to said percentages.

4. The method defined in claim 3, further comprising the step of, prior to initiating a tap change operation, effecting a zero measurement to establish a nominal value for the measured value as a starting value for the parameter data used in step (e).

5. The method defined in claim 4 wherein said measured value is a torque measured at a drive shaft between a motor drive and the tap changer.

6. The method defined in claim 1 wherein the parameter data stored in said nonvolatile memory includes a set of deviations of measured values in terms of percentages of a nominal value and respective one of said classification categories assigned to said classification categories.

7. The method defined in claim 6, further comprising the step of, prior to initiating a tap change operation, effecting a zero measurement to establish a nominal value for the measured value as a starting value for the parameter data used in step (e).

8. The method defined in claim 1 wherein said measured value is a torque measured at a drive shaft between a motor drive and the tap changer.

* * * * *